United States Patent [19]

Habrich et al.

[11] Patent Number: 4,783,319

[45] Date of Patent: Nov. 8, 1988

[54] APPARATUS FOR MIXING REACTION RESIN COMPOUNDS AND FOR KEEPING THE PRESSURE OF SAID REACTION RESIN COMPOUNDS CONSTANT

[75] Inventors: Reiner Habrich, Kirchheim; Manfred Bauer, Munich, both of Fed. Rep. of Germany

[73] Assignee: Siemens Aktiengesellschaft, Berlin and Munich, Fed. Rep. of Germany

[21] Appl. No.: 80,212

[22] Filed: Jul. 29, 1987 (Under 37 CFR 1.47)

Related U.S. Application Data

[63] Continuation of Ser. No. 824,457, Jan. 31, 1986, abandoned.

[51] Int. Cl.[4] ..... B01F 5/12

[52] U.S. Cl. ..... 422/135; 422/210; 422/227; 366/174; 366/267; 366/336; 366/337; 366/340

[58] Field of Search ..... 366/174

[56] References Cited

U.S. PATENT DOCUMENTS

| | | | |
|---|---|---|---|
| 4,043,352 | 8/1977 | Simpson | 138/31 |
| 4,189,243 | 2/1980 | Black | 366/336 |
| 4,313,680 | 2/1982 | Honnen | 366/337 |
| 4,408,892 | 10/1983 | Combes | 366/337 |
| 4,478,516 | 11/1984 | Kessler | 366/340 |
| 4,510,120 | 4/1985 | Bauer | 422/135 |

*Primary Examiner*—Kenneth M. Schor
*Assistant Examiner*—Lori-Ann Johnson
*Attorney, Agent, or Firm*—Hill, Van Santen, Steadman & Simpson

[57] ABSTRACT

The apparatus is composed of a flow-through mixer which is followed by a repressing means composed of a cylinder and movable piston downstream in the direction of the conveying stream. In order to avoid cross-sectional constrictions in this apparatus due to sedimentation of reaction resin compounds and/or filler, a flow-through mixer integrated in the piston is provided, the discharge opening of this flow-through mixer discharging directly into the cylinder of the repressing means. The overall apparatus functions in a direct flow-through, i.e. the dwell time of the reactive resin compounds in the apparatus is limited to a minimum.

8 Claims, 1 Drawing Sheet

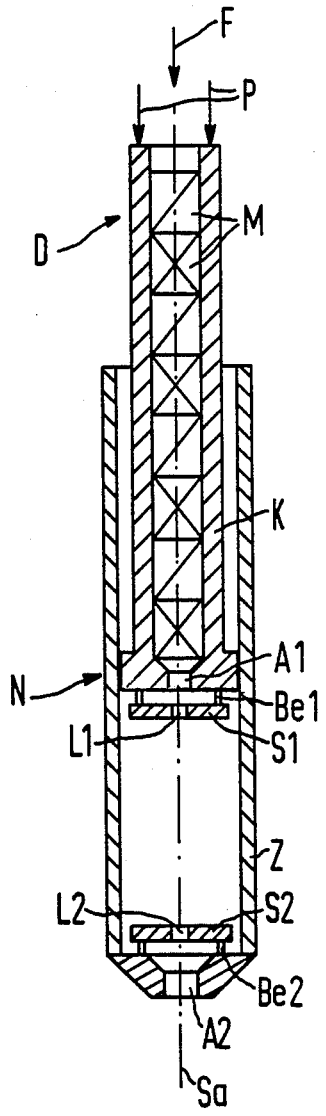
F
P
D
M
K
A1
N
Be1
L1
S1
Z
L2
S2
Be2
A2
Sa

APPARATUS FOR MIXING REACTION RESIN COMPOUNDS AND FOR KEEPING THE PRESSURE OF SAID REACTION RESIN COMPOUNDS CONSTANT

This is a continuation, of application Ser. No. 824,457, filed Jan. 31, 1986 now abandoned.

BACKGROUND OF THE INVENTION

1. Field of the Invention

The invention relates to an apparatus for mixing reaction resin compounds and for keeping the pressure of the said reaction resin compounds constant.

2. Description of the Prior Art

Reaction resin compounds are manufactured by mixing precisely prescribed quantities of resin and hardener, whereby a plurality of resins and a plurality of hardeners are used in many cases. Morever, additional substances such as fillers, dyestuffs, adhesion promoters, accelerators and the like can also be distributed into the resin and the hardener components. In the automatic production of such reaction resin compounds from, for example, one resin and one hardener component by means of oscillating or rotating displacement pumps and static or dynamic flow-through mixers, it is often necessary to manage the flow of the reactive resin compound in continuous fashion and/or to keep this flow under a defined pressure. This is particularly true when the reactive resin compound is introduced into a closed form immediately after mixing the two initial components and is hardened or gelled under pressure. This also applies when the flow-through mixer of such a resin preparation system is coupled to a multiple metering apparatus since a material buffer under a defined pressure is necessary for the exact function of the metering means. Special problems arise in the employment of highly reactive resin compounds having a handling time of less than one hour and/or when using rapidly sedimenting, filled reaction resin compounds. It is thereby necessary to keep the dwell time of the reaction resin compounds in the system extremely short and to avoid the sedimentation of reaction resin compound and/or filler.

For the compensation of the pulsation and in order to keep the pressure constant in the automatic preparation of reactive resin compounds, German AS No. 27 46 050 discloses that the static or the dynamic flow-through mixer be followed by what is referred to as a repressing apparatus. The employment of such a repressing apparatus comprising a cylinder and movable piston, however, leads to a longer dwell time of the reaction resin compound in the pipe conduits or to an additional pressure loss in the compound flow. Particularly given highly reactive compounds, a hardening resin layer quickly forms at the walls, this resulting in corresponding constrictions of the cross-section. In addition to frequent interruptions in operation, the elimination of such cross-sectional constrictions requires a high expenditure for maintenance and cleaning.

SUMMARY OF THE INVENTION

An object of the invention is to provide an apparatus for mixing reaction resin compounds and for keeping the pressure of the reaction resin compounds constant wherein the formation of cross-sectional constrictions due to sedimentation of reaction resin compound and/or filler is at least largely avoided.

This object is achieved in an apparatus for mixing reaction resin compounds and for keeping the pressure of those reaction resin compounds constant which has a flow-through mixer and a repressing means following downstream thereof in the direction of the conveying stream and a cylinder with a piston movable relative to the cylinder by integrating the flow through mixer in the piston with the discharge opening of the mixer discharging directly into the cylinder.

The invention is based on the perception that, by integrating the flow-through mixer in the piston of the repressing device, the reaction resin compound freshly prepared in the flow-through mixer proceeds directly into the cylinder of the repressing device and that, thereby, the first reaction resin compound introduced into the cylinder is the first that is in turn conveyed out. The overall apparatus thus functions in direct flow-through, whereby the dwell time of the reaction resin compound is limited to a minimum and the risk of a sedimentation of reaction resin compound and/or filler is at least largely avoided. A further advantage of the apparatus of the invention is that a following device, such as, for example, a multiple metering device, a closed casting mold or a casting valve, can be directly connected to the cylinder of the repressing apparatus and, thus, extremely short connections are achieved. This is of decided significance particularly in view of the short dwell time of the already activated resin compound which is required in the system.

In accord with a further development of the invention, a static flow-through mixer is integrated in the piston. Since no rotating mixing member is required given such static flow-through mixers, the integration into the movable piston of the repressing apparatus can be managed in a particularly simple fashion. In particular, the static flow-through mixer can be formed with a minimum of outlay by mixer elements inserted into an axial bore of the piston.

The risk of sedimentation at the floor of the piston of the repressing apparatus can be further reduced in that a first flow guide means situated at a distance from the floor of the piston is secured in the direction of the conveying flow following the discharge opening of the flow-through mixer. In a corresponding fashion, the risk of sedimentation at the floor of the cylinder can then also be further reduced in that a second flow guide means is secured at a distance from the floor of the cylinder in the direction of the conveying stream preceeding the discharge opening of the cylinder. The conveying stream can be deflected with the assistance of such flow guide means, that, given at least approximately identical flow velocities, the flow is elevated in those regions critical for sedimentations and, in particular, dead spaces of the flow are avoided. This can be realized in a particularly simple fashion when the flow guide means are fashioned disk-shaped. It has also proven particularly advantageous in view of an optimization of the flow conditions when a central hole dimensioned for the passage of a part of the conveying stream is introduced into each of the flow guide means.

BRIEF DESCRIPTION OF THE DRAWINGS

An exemplary embodiment of the invention is shown in the drawing in a side sectional view.

DESCRIPTION OF THE PREFERRED EMBODIMENTS

In a greatly simplified, schematic illustration, the drawing shows an apparatus for mixing reaction resin compounds and for keeping the pressure of the reaction resin compounds constant wherein a static flow-through mixer D and the cylinder Z of a repressing means referenced N overall are sucessively flowed through in the direction of the conveying stream indicated by an arrow F. The static flow-through mixer D integrated into the movable piston K of the repressing means N is thereby formed by a plurality of mixer elements M inserted into an axial bore B of the piston K.

As seen in the direction of the conveying stream F, a first flow guide means S1 arranged at a distance from the floor of the piston K is secured following the discharge opening A1 of the static flow-through mixer D, this discharge opening A1 being tapered in comparison to the axial bore B, a central hole L1 being introduced into said first flow guide means S1. The fastening of the first flow guide means S1 having the shape of a disk, to the floor of the piston K ensues with the assistance of a plurality of small legs Be1 formed in a flow promoting way in profile via which the distance between the floor of the piston K and the first flow guide means S1 is also simultaneously prescribed.

As seen in the direction of the conveying stream F, a second flow guide means S2 situated at a distance from the floor of the cylinder Z is secured preceeding the discharge opening A2 of the cylinder Z, a central hole L2 being introduced into said second flow guide means S2. The fastening of this second flow guide means S2, which is likewise in the form of a disk, to the floor of the cylinder Z again ensues here with the assistance of a plurality of small legs Be2 formed in flow-promoting fashion in profile, whereby the distance between the floor of the cylinder Z and the second flow guide means S2 is simultaneously prescribed via these small legs Be2.

Given utilization of the above-described apparatus in a casting resin preparation system, the resin and the hardener components are supplied via volumetric metering devices operating in constrained fashion, being supplied to the static flow-through mixer D in the proper mixing ratio such that they synchronously flow through the flow-through mixer D. Since the static flow-through mixer D is integrated in the movable piston K of the repressing means N, the connection to the stationarily situated volumetric metering devices is undertaken via a flexible line, for example via a flexible hose composed of polyamide or a fluoro-elastomer. When flowing through the static flow-through mixer D, the mixer elements M effect a multiple parting and superimposition of the component streams which are brought together, so that a uniform mixture of the reaction resin compound proceeds through the discharge opening A1 into the cylinder Z of the re-pressing means N.

Without deflection, a part of the reaction resin compound emerging from the discharge opening A1 then flows through the central hole L1 of the first flow guide means S1 in the direction of the axis of symmetry Sa of the overall apparatus, whereas the other part flows radially out in all directions along the floor of the piston K and is then deflected in axial direction via the annular gap formed between the inside wall of the cylinder Z and the outside circumference of the first flow guide means S1. As a consequence of this management of the conveying stream F, a sedimentation of reaction resin compound and/or filler at the floor of the piston K can be reliably avoided.

Upon discharge from the cylinder Z, one part of the reaction resin compound flows through the central hole L2 of the second flow guide means S2 in the direction of the axis of symmetry Sa without deflection and flows out through the discharge opening A2 of the cylinder Z. The other part of the reaction resin compound flows in axial direction through the annular gap formed between the inside wall of the cylinder Z and the outer circumference of the second flow guide means S2 and then flows radially in all directions along the floor of the cylinder Z until it enters into the discharge opening A2 which first comprises the shape of a truncated cone. As a consequence of this management of the conveying stream F, a sedimentation of reaction resin compound and/or filler at the floor of the cylinder Z is reliably suppressed. The reaction resin compound then proceeds from the discharge opening A2 directly into a following device such as, for example, into a multiple metering apparatus, a closed casting mold or a casting valve.

Metals or plastics which are standard in the processing of reaction resin compounds are suitable as materials for the manufacture of the apparatus shown in the drawing. Rustproof steels are preferably employed. Sealing packings of synthetic preferably designed as lip seals are provided for sealing the piston K relative to the inside wall of the cylinder Z, these sealing packings not being shown in detail in the schematic drawing. The piston K includes a diminished diameter following the guidance region provided with these sealing packings, this being particularly intended to make a seizing and canting of the piston K in the cylinder Z impossible.

The piston K can be loaded in axial direction with a force indicated by arrows P, this force being exerted, for example, by pneumatic or hydraulic actuators. On the basis of an appropriate control of this force P, the re-pressing means N can then buffer pulsations of the conveying stream F of the preparation system and can act as a supply and pressure vessel for a following apparatus connected to the cylinder Z.

However, it is also possible to situate the piston K with the integrated flow-through mixer D stationarily and to have the force P act on the cylinder Z. In this case, a flexible connecting line to the corresponding, stationarily situated following apparatus is then connected to the discharge opening A2 of the cylinder C.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

We claim as our invention:

1. An apparatus for mixing reaction resin compounds and for keeping the pressure of said reaction resin compounds substantially constant comprising:

a cylinder having a longitudinal axis;

a piston having a termination floor within said cylinder and movable within said cylinder along said longitudinal axis to keep the pressure of said reaction resin compounds in said cylinder constant;

cylinder discharge means in said cylinder for ejecting said reaction resin compounds from said cylinder;

a flow-through mixer for said reaction resin compounds integrated in said piston and terminating in a piston discharge means through said piston termination floor for ejecting said reaction resin compounds into said cylinder; and means carried on said piston and positioned with respect to said cylinder so as to confine reaction resin compounds ejected from said piston discharge means in a volume between the termination floor of said piston and said cylinder discharge means prior to being discharged through said cylinder discharge means.

2. An apparatus according to claim 1, wherein said flow-through mixer is a static flow-through mixer.

3. An apparatus according to claim 2, wherein said static flow-through mixer is formed by mixer elements inserted into an axial bore of said piston.

4. An apparatus according to claim 1, wherein a first flow guide means situated at a distance from a floor of said piston is secured downstream of the discharge opening of said flow-through mixer.

5. An apparatus according to claim 4, wherein a second flow guide means is situated at a distance from a floor of said cylinder and is secured upstream of the discharge opening of said cylinder.

6. An apparatus according to claim 5, wherein said flow guide means are formed disk-shaped.

7. An apparatus according to claim 4, wherein a central hole dimensioned for the passage of a part of said conveying stream is provided in said flow guide means.

8. An apparatus according to claim 5, wherein a central hole dimensioned for the passage of a part of said conveying stream is provided in said second flow guide means.

* * * * *